US009576758B2

(12) United States Patent
He et al.

(10) Patent No.: US 9,576,758 B2
(45) Date of Patent: Feb. 21, 2017

(54) PORTABLE SINGLE-PHASE AIR BYPASS SWITCH FOR LIVE POWER DISTRIBUTION NETWORK

(71) Applicants: CHANG ZHOU CURRENT SUPPLY COMPANY OF JIANGSU ELECTRIC POWER COMPANY, Changzhou (CN); JIANGSU ELECTRIC POWER COMPANY, Nanjing (CN); STATE GRID CORPORATION OF CHINA, Beijing (CN)

(72) Inventors: Jianjun He, Changzhou (CN); Zhen Xu, Changzhou (CN); Hui Zhu, Changzhou (CN)

(73) Assignees: CHANG ZHOU CURRENT SUPPLY COMPANY OF JIANGSU ELECTRIC POWER COMPANY, Changzhou (CN); JIANGSU ELECTRIC POWER COMPANY, Nanjing (CN); STATE GRID CORPORATION OF CHINA, Beijing (CN)

( * ) Notice: Subject to any disclaimer, the term of this patent is extended or adjusted under 35 U.S.C. 154(b) by 0 days.

(21) Appl. No.: 14/786,140

(22) PCT Filed: Apr. 21, 2014

(86) PCT No.: PCT/CN2014/075787

§ 371 (c)(1),
(2) Date: Oct. 21, 2015

(87) PCT Pub. No.: WO2014/173266

PCT Pub. Date: Oct. 30, 2014

(65) Prior Publication Data

US 2016/0126038 A1 May 5, 2016

(30) Foreign Application Priority Data

Apr. 22, 2013 (CN) ..... 2013 1 0140481
Apr. 22, 2013 (CN) ..... 2013 2 0207643 U

(51) Int. Cl.
*H01H 33/73* (2006.01)
*H01H 3/30* (2006.01)
*H01H 31/00* (2006.01)

(52) U.S. Cl.
CPC ..... *H01H 33/73* (2013.01); *H01H 3/3042* (2013.01); *H01H 31/006* (2013.01); *H01H 2205/002* (2013.01); *H01H 2235/01* (2013.01)

(58) Field of Classification Search
CPC ..... H01H 3/30; H01H 3/3042; H01H 31/006; H01H 33/14; H01H 33/16; H01H 33/73
(Continued)

(56) References Cited

U.S. PATENT DOCUMENTS 6,078,008 A * 6/2000 Wood ..... H01R 11/15 174/44
6,875,917 B1 * 4/2005 Wood ..... H02G 1/02 174/38
2013/0075125 A1 * 3/2013 Wood ..... H02G 1/02 174/44

FOREIGN PATENT DOCUMENTS

CN 201812691 U 4/2011
CN 102194618 A 9/2011
(Continued)

OTHER PUBLICATIONS

The World Intellectual Property Organization (WIPO) International Search Report for PCT/CN2014/075787 Jul. 18, 2014.

*Primary Examiner* — Renee S Luebke
*Assistant Examiner* — William Bolton
(74) *Attorney, Agent, or Firm* — Anova Law Group, PLLC

(57) ABSTRACT

The present invention provides a portable single-phase air bypass switch for live power distribution network, including a housing member, a positioning member, a conductive circuit member, a clutch member, a switch-closing member
(Continued)

and a switch-opening member. The positioning member includes a positioning nut, positioning frames, and a positioning column. The conductive circuit member includes a conductive end cover, an upper conductive rod, a pressing sleeve, a coupling nut, a conductive sleeve pipe, a stationary contact, a movable contact, and a lower conductive rod. The switch-closing member includes a switch-closing energy-storage rod, a switch-closing energy-storage ring, a switch-closing spring, a switch-closing positioning pin, a switch-closing release ring, and an inner sleeve pipe. The switch-opening member includes a small shaft, a switch-opening spring, a stopping block, a switch-opening energy-storage shaft, a connection rod, a switch-opening energy-storage pressing head, a switch-opening positioning pin, and a switch-opening release ring.

7 Claims, 4 Drawing Sheets

(58) Field of Classification Search
USPC ..... 218/46; 174/44, 45 R
See application file for complete search history.

(56) References Cited

FOREIGN PATENT DOCUMENTS

| | | | |
|---|---|---|---|
| CN | 102347173 | A | 2/2012 |
| CN | 203205266 | U | 9/2013 |
| JP | 2010257625 | A | 11/2010 |

* cited by examiner

PORTABLE SINGLE-PHASE AIR BYPASS SWITCH FOR LIVE POWER DISTRIBUTION NETWORK

FIELD OF THE DISCLOSURE

The present disclosure relates to the field of devices operating in live power distribution network and, more particularly, relates to a portable single-phase air bypass switch for live 10 KV power distribution network.

BACKGROUND

Work on live 10 KV power distribution network may include performing maintenance and repair work after making certain portion of the power line or equipment out of operation by disconnecting or connecting a tension lead or a branch connector of an unloaded overhead power line portion. Disconnecting and connecting an unloaded overhead power line account for more than 80% of entire live distribution network projects. Arc suppression method and technologies are an essential technical aspect of working on live power distribution network. When calculated value of capacitive current is greater than 0.3 A, a specialized arc-suppression switch should be used for operation. Currently, arc-suppression devices dedicated for live power distribution networks are very scarce. Common domestic and foreign bypass switches designed for live distribution networks may include two types: single-phase type and three-phase type. USLR-XLT series air bypass switch from Utility Solutions Co., Ltd may be a typical representative single-phase air bypass switch product. However, such products often have low closing speed. In practical scenarios, when breaking an unloaded line with high capacitive current, the contact head may be burned and damaged. Further, the switch only has a closing function instead of having both quick opening and quick closing functionalities, which limits its application scenarios. Other common single-phase bypass switches usually have small capacity, whose capacitive current is less than or equal to 3 A during switch opening or switch closing. Further, engaging status between stationary contact and movable contact is not visible, which brings safety concerns. Three-phase type switches implement SF6 load switch principles, and may be represented by SG030 products from San-Eisha, Ltd in Japan. Although this type of products may completely satisfy functional requirements for live power distribution network, these products generally are bulky and heavy, which largely increases work intensity of workers and reduces operation efficiency, and thus have low applicability.

BRIEF SUMMARY OF THE DISCLOSURE

The purpose of this invention is to provide a portable single-phase air bypass switch for a live power distribution network. The disclosed switch integrates fast-opening and fast-closing functionalities. The charging current for breaking or returning an unloaded line is greater than 10 A. The engaging status between a stationary contact and a movable contact is visible. During operation, the switch may be hung on an overhead loaded line using a conductive rod and without a frame or base. The switch may satisfy live distribution network requirements for 10 KV power distribution network, and fill gaps at home and abroad.

One aspect of the present invention provides s a portable single-phase air bypass switch for a live power distribution network, including a housing member, a positioning member, a conductive circuit member, a clutch member, a switch-closing member and switch-opening member.

The housing member includes a main sleeve tube, an insulating sleeve pipe, a flange sleeve and a bottom cover. The positioning member includes a positioning nut, positioning frames and a positioning column. The conductive circuit member includes a conductive end cover, an upper conductive rod, a pressing sleeve, a coupling nut, a conductive sleeve pipe, a stationary contact, a movable contact and a lower conductive rod. The clutch member includes a clutch, a clutch ring and a clutch sleeve pipe. The switch-closing member includes a switch-closing energy-storage rod, a switch-closing energy-storage ring, a switch-closing spring, a switch-closing positioning pin, a switch-closing release ring, and an inner sleeve pipe. The switch-opening member include a small shaft, a switch-opening spring, a stopping block, a switch-opening energy-storage shaft, a connection rod, a switch-opening energy-storage pressing head, a switch-opening positioning pin, and a switch-opening release ring.

The insulating sleeve pipe and the outer periphery of the upper part of the main sleeve tube may be connected with an interference fit. The conductive sleeve pipe and the inner periphery of the upper part of the main sleeve tube may be connected with an interference fit. The coupling nut may be a nut with both internal screw threads and external screw threads. The coupling nut may have threaded connection with the lower end of the upper conductive rod by the internal screw thread. The coupling nut may have threaded connection with the inner wall of the upper part of the conductive sleeve pipe by the external screw thread. The positioning nut may have threaded connection with the upper conductive rod, and may be located above the coupling nut. The pressing sleeve may have threaded connection with the upper conductive rod and may be located above the positioning nut. The flange sleeve may cover the pressing sleeve from top to bottom and have threaded connection with the outer wall of the upper end of the insulating sleeve pipe. The upper conductive rod may be fixedly connected with the conductive end cover.

The positioning column may be coupled and connected to the lower part inside the main sleeve tube. The bottom cover may be coupled and connected to the lower end of the main sleeve tube. Further, the bottom cover may be fixedly connected with the positioning column. The left side and the right side of the vertically waist portion of the positioning column are respectively provided with a switch-closing positioning pin-hole and a switch-opening positioning pin-hole. The main sleeve tube may be configured to have a switch-closing positioning pin through-hole and a switch-opening positioning pin through-hole at corresponding locations of the switch-closing positioning pin-hole and the switch-opening positioning pin-hole of the positioning column. The switch-closing positioning pin and the switch-opening positioning pin may respectively pass through the switch-closing positioning pin through-hole and the switch-opening positioning pin through-hole in the main sleeve tube, and may be movably located in the switch-closing positioning pin-hole and the switch-opening positioning pin-hole of the positioning column. The switch-closing release ring may be elastically connected with the switch-closing positioning pin by torsion spring. The switch-opening release ring may have elastic connection with the switch-opening positioning pin by torsion spring. There are two positioning frames. The two positioning frames may be respectively configured at the left side and the right side of the main sleeve tube and are fixedly connected with the main sleeve tube. The stationary contact may have threaded connection with the inner wall of the lower end of the conductive sleeve pipe. The movable contact may be located underneath the stationary contact. The clutch member may be configured inside the conductive sleeve pipe and located underneath the upper conductive rod. The switch-closing spring may be configured inside the conductive sleeve pipe. The switch-closing spring may be located in between the clutch member and the stationary contact.

The bottom cover, the positioning column, the movable contact, and the stationary contact may be configured to have vertical through-holes at the lateral side in left-right direction and at the center. The switch-closing energy-storage rod may pass through, sequentially from bottom to top, the through-holes at the lateral side of the bottom cover, the positioning column, the movable contact and the stationary contact. The upper end of the switch-closing energy-storage rod may be fixedly connected with the clutch. The switch-closing energy-storage ring may be fixedly mounted at the lower end of the switch-closing energy-storage rod. The upper end of the inner sleeve pipe may have threaded connection with the clutch sleeve pipe. The lower end of the inner sleeve pipe may have threaded connection with the movable contact.

The upper part of the small shaft may be coupled and connected inside the upper conductive rod. The middle and lower parts of the small shaft may have movable fit and connect with an inner chamber of the clutch and inside the upper part of the inner sleeve pipe. The switch-opening spring may be configured inside the inner sleeve pipe. The upper end of the switch-opening spring may contact the lower end of the small shaft. The lower end of the switch-opening spring may contact the upper end surface of the stopping block. The lower end of the stopping block may pass through the through-hole at the center of the movable contact and have threaded connection with the upper end of the switch-opening energy-storage shaft. The lower end of the switch-opening energy-storage shaft may have threaded connection with the upper end of the connection rod. The connection rod may have movable fit and connect to the through-hole in the center of the positioning column. The lower end of the connection rod may have threaded connection with the switch-opening energy-storage pressing head.

The front lateral side of the lower part of the main sleeve tube may be configured to have a through-hole to pass through conductive cords. The lower conductive rod may be a hollow round tube. One end of the lower conductive rod may be fixedly connected with the main sleeve tube at where the through-hole for passing through conducting cords may be located.

Further, the main sleeve tube of the housing member may be a one-piece hollow cylinder made of transparent insulating polycarbonate. The insulating sleeve pipe may be a one-piece hollow cylinder made of insulated polycarbonate. The inner diameter of the insulating sleeve pipe is compatible with the outer diameter of the main sleeve tube. The outside wall of the upper part of the insulating sleeve pipe may be configured to have external screw threads. The flange sleeve may be a whole piece made of nylon. The flange sleeve may include an upper plate, a main-body portion and a ring portion, all of which are connected together as one piece. The upper plate of the flange sleeve may be a round-shaped plate. The center of the flange sleeve may be configured to have a vertical circular through-hole. The main-body portion of the flange sleeve may be configured to have a hollow cylindrical shape, and have internal screw threads in the inner wall for assembling connection. The ring portion of the flange sleeve may be configured to have a ring shape and extend from the lower end of the main-body portion. The bottom cover may be a whole piece made of aluminum alloy. The bottom cover may include a round-shaped bottom plate and a ring portion, both of which are connected together as one piece. The ring portion of the bottom cover may be configured on top of the bottom plate. The outer diameter of the ring portion may be the same as the diameter of the bottom plate.

Further, the positioning nut of the positioning member may be a round-shaped nut made of nylon, whose outer diameter is compatible with the inner diameter of the insulating sleeve pipe. The inner wall of the poisoning nut may be configured to have internal screw threads for connection. The positioning frame may be a whole piece made of aluminum alloy. The positioning frame may include two ear plates and a central connection plate, all of which may be connected together as one piece. The two ear plates are respectively located at the front side and the back side of the central connection plate symmetrically. The two ear plates are each configured to have a locking pin hole at symmetrical positions. The inner end surface of the central connection plate of the positioning frame may be curved. The central connection plate may be configured to have a through-hole for a positioning pin. The positioning column may be a cylindrical whole piece made of aluminum alloy. The outer diameter of the positioning column is compatible with the inner diameter of the main sleeve tube.

Further, the conductive circuit member further includes conductive cords. The conductive end cover may be a whole piece made of copper. The conductive end cover includes a circular upper plate and an annular edge, both of which may be connected together as one piece. The annular edge of the conductive end cover may be configured to have an upwardly recessed suspension groove.

The upper conductive rod may be a whole piece made of copper. The upper conductive rod may include, sequentially from top to bottom, a top portion, a connection portion, a cylinder portion and a ring portion, all of which are connected together as one piece. The overall shape of the top portion of the upper conductive rod may be a flat cylinder. The top portion of the upper conductive rod may be configured inside the annular edge of the conductive end cover. The top surface of the upper conductive rod may contact the bottom surface of the circular upper plate of the conductive end cover. The top portion of the connection rod may be configured to have an upwardly recessed notch compatible with the suspension groove of the conductive end cover. The connection portion of the upper conductive rod may be basically a circular truncated cone having a trapezoidal cross-section. The cylinder portion of the upper conductive rod may be a hollow cylinder. The outer wall of the cylinder portion may be configured to have external screw threads for connection. The ring portion of the upper conductive rod may be configured at the lower end of the cylinder portion and extend outwardly. The central hole of the cylinder portion of the upper conductive rod may be a socket hole for fitting the small shaft.

The pressing sleeve may be a whole piece made of copper or aluminum. The pressing sleeve may include, sequentially from top to bottom, an upper cylinder portion, a middle cylinder portion and a lower cylinder portion, all of which are connected together as one piece. The center of the upper cylinder portion, the middle cylinder portion and the lower cylinder portion of the pressing sleeve may have coaxial circular through-holes in vertical direction with same inner diameter. The inner diameter of the circular through-holes is compatible with the outer diameter of the cylinder portion of the upper conductive rod. The inner walls of the circular through-holes may be configured to have internal screw threads for connection. The outer diameter of the upper cylinder portion of the pressing sleeve is compatible with the inner diameter of circular through-hole in the upper plate of the flange sleeve. The outer diameter of the middle cylinder portion of the pressing sleeve is compatible with the inner diameter of the flange sleeve. The outer diameter of the lower cylinder portion of the pressing sleeve is compatible with the inner diameter of the insulating sleeve pipe.

The coupling nut may be a round-shaped nut made of copper. The inner diameter of the coupling nut is compatible with the outer diameter of the cylinder portion of the upper conductive rod. The outer diameter of the coupling nut is compatible with the inner diameter of the conductive sleeve pipe. The conductive sleeve pipe may be a hollow round tube made of aluminum alloy. The inner walls of the upper end and the lower end of the conductive sleeve pipe are both configured with internal screw threads for connection.

The stationary contact may be a whole piece made of copper, including, from top to bottom, a truncated cone portion, a serration base portion and serrated protrusions. The truncated cone portion of the stationary contact may include an upper plate and a cylinder part. The upper plate may be a round-shaped plate. A lateral through-hole and a central through-hole may be respectively configured at the lateral side and the center of the upper plate. The cylinder part of the stationary contact may be a hollow cylinder. The outer diameter of the cylinder portion may be the same as the outer diameter of the upper plate. The top surface of the cylinder portion and the bottom surface of the upper plate may be integrally connected. The serration base portion may include a connection panel and a skirt edge. The connection panel of the serration base portion may be a ring-shaped plate, whose outer diameter may be greater than the outer diameter of the cylinder part of the truncated cone portion. The inner wall of the ring-shaped connection panel of the serration base portion may be integrally connected to the lower end of the outer wall of the cylinder part of the truncated cone portion. The skirt edge of the serration base portion may be a ring-shaped plate, whose upper end may be integrally-connected with the outer periphery of the bottom surface of the connection panel of the serration base portion. There may be 6 to 20 serrated protrusions. The structures of the serrated protrusions may generally be the same. The upper end of each serrated protrusion is integrally connected with the lower end of the skirt edge of the serration base portion. The serrated protrusions are distributed with even spacing. The serrated protrusions together form a surrounding ring.

The movable contact may be a step-shaped whole piece made of copper. The movable contact may include a hollow cylinder portion configured at the upper part and a flat cylinder portion configured at the lower part, both of which may be connected together as one piece. The outer diameter of the cylinder portion of the movable contact may be less than the outer diameter of the cylinder portion. Further, the outer diameter of the cylinder portion of the movable contact is compatible with the inner diameter of the skirt edge of the serration base portion of the stationary contact. The inner wall of the cylinder portion of the movable contact may be configured to have internal screw threads for connection. The through-holes at the lateral side and at the center of the movable contact are configured at the lateral side and at the center of flat cylinder portion.

One end of the conductive cord may be electrically connected with the movable contact. The other end of the conductive cord leads out from the lower conductive rod.

Further, the clutch of the clutch member may be configured to have a hollow cylindrical inner chamber. The clutch ring may be coupled and connected to the upper outer side of the clutch. The clutch sleeve pipe may be formed by integrally connected hollow upper cylindrical portion and a hollow lower cylindrical portion. The outer diameter of the lower cylindrical portion of the clutch sleeve pipe may be greater than the outer diameter of the upper cylindrical portion. The upper cylindrical portion of the clutch sleeve pipe may be flexibly coupled and connected to the inner chamber of the clutch. The inner wall of the lower cylindrical portion of the clutch sleeve pipe may be configured with internal screw threads for connection.

Further, the switch-closing energy-storage rod of the switch-closing member may have a rod body and made of insulated polycarbonate. The material of the switch-closing energy-storage ring and the switch-closing release ring may be aluminum alloy. The inner sleeve pipe may be a hollow pipe made of epoxy resin. The outer walls of the upper end and lower end of the inner sleeve pipe may both be configured to have external screw threads. The outer diameter of the inner sleeve pipe is compatible with the inner diameter of the lower cylindrical portion of the clutch sleeve pipe, and compatible with the inner diameter of the cylinder portion of the movable contact.

Further, the small shaft of the switch-opening member may be a whole piece made of epoxy resin. The small shaft may include integrally connected upper cylinder portion and a hollow lower cylinder portion. The diameter of the upper cylinder portion of the small shaft is compatible with the inner diameter of the hollow cylinder portion of the upper conductive rod. The outer diameter of the lower cylinder portion of the small shaft is compatible with the inner chamber of the clutch and the inner diameter of the inner sleeve pipe. The stopping block may be a whole piece made of stainless steel. The stopping block may include an upper cylinder portion, a middle cylinder portion and a lower cylinder portion, all of which are connected together as one piece. Further, the outer diameters of the upper cylinder portion, the middle cylinder portion and the lower cylinder portion are sequentially decreased. The outer wall of the lower cylinder portion of the stopping block may be configured to have external screw threads for connection.

The switch-opening energy-storage shaft may be a cylindrical whole piece made of nylon. The centers of the upper end and the lower end of the switch-opening energy-storage shaft may each be configured to have an inwardly recessed round hole. Further, the inner walls of the two round holes may both be configured to have internal screw threads for connection. The connection rod may be a whole piece made of stainless steel. The connection rod may include an upper cylinder portion, a middle cylinder portion and a lower cylinder portion, all of which are connected together as one piece. The outer walls of the upper cylinder portion and the lower cylinder portion of the connection rod may both be configured to have external screw threads for connection. The middle cylinder portion of the connection rod may be configured to have an inwardly recessed positioning groove around the waist.

The switch-opening energy-storage pressing head may be a whole piece made of aluminum alloy. The switch-opening energy-storage pressing head may include a connection portion configured at the upper end and a pressing portion at the lower end, both of which may be connected together as one piece. The connection portion of the switch-opening energy-storage pressing head may be a hollow cylinder, the inner wall of which may be configured to have internal screw threads for connection. The pressing portion of the switch-opening energy-storage pressing head may have an arc shape projecting downward.

Figure 1:
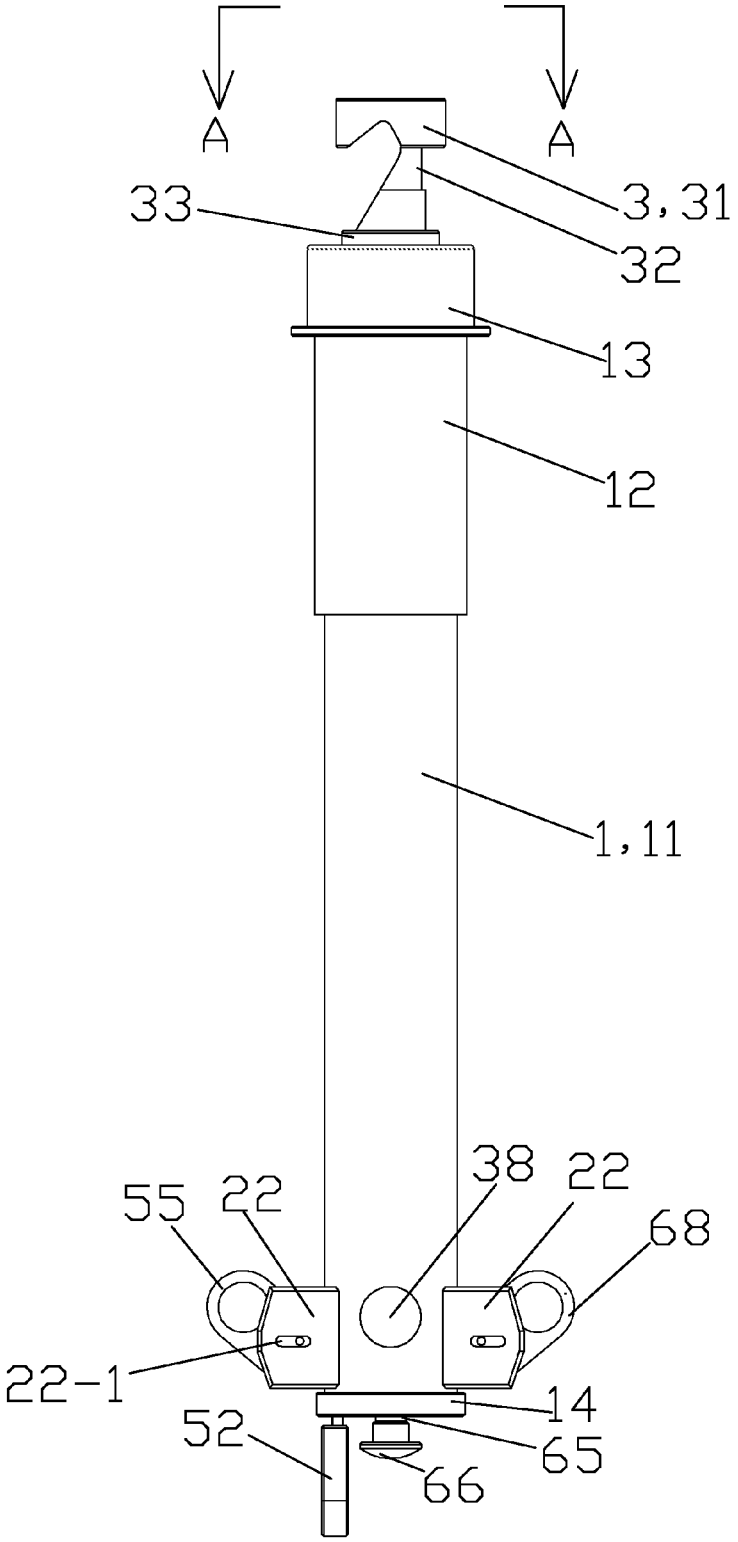
FIG. 1 is an illustration of a structural diagram of the present disclosure.

Reference numbers used in the figures: housing member 1, main sleeve tube 11, insulating sleeve pipe 12, flange sleeve 13, bottom cover 14; positioning member 2, positioning nut 21, positioning frame 22, locking pin hole 22-1, positioning column 23; conductive circuit member 3, conductive end cover 31, circular upper plate 31-1, annular edge 31-2, suspension groove 31-3, upper conductive rod 32, pressing sleeve 33, coupling nut 34, conductive sleeve 35, stationary contact 36, movable contact 37, lower conductive rod 38; clutch member 4, clutch 41, clutch ring 42, clutch sleeve pipe 43; switch-closing member 5, switch-closing energy-storage rod 51, switch-closing energy-storage ring 52, switch-closing spring 53, switch-closing positioning pin 54, switch-closing release ring 55, inner sleeve 56; switch-opening member 6, small shaft 61, switch-opening spring 62, stopping block 63, switch-opening energy-storage shaft 64, connection rod 65, switch-opening energy-storage pressing head 66, switch-opening positioning pin 67, and switch-opening release ring 68.

DETAILED DESCRIPTION

The present disclosure is further described in details together with various embodiments and accompanying drawings.

Embodiment 1

Figure 2:
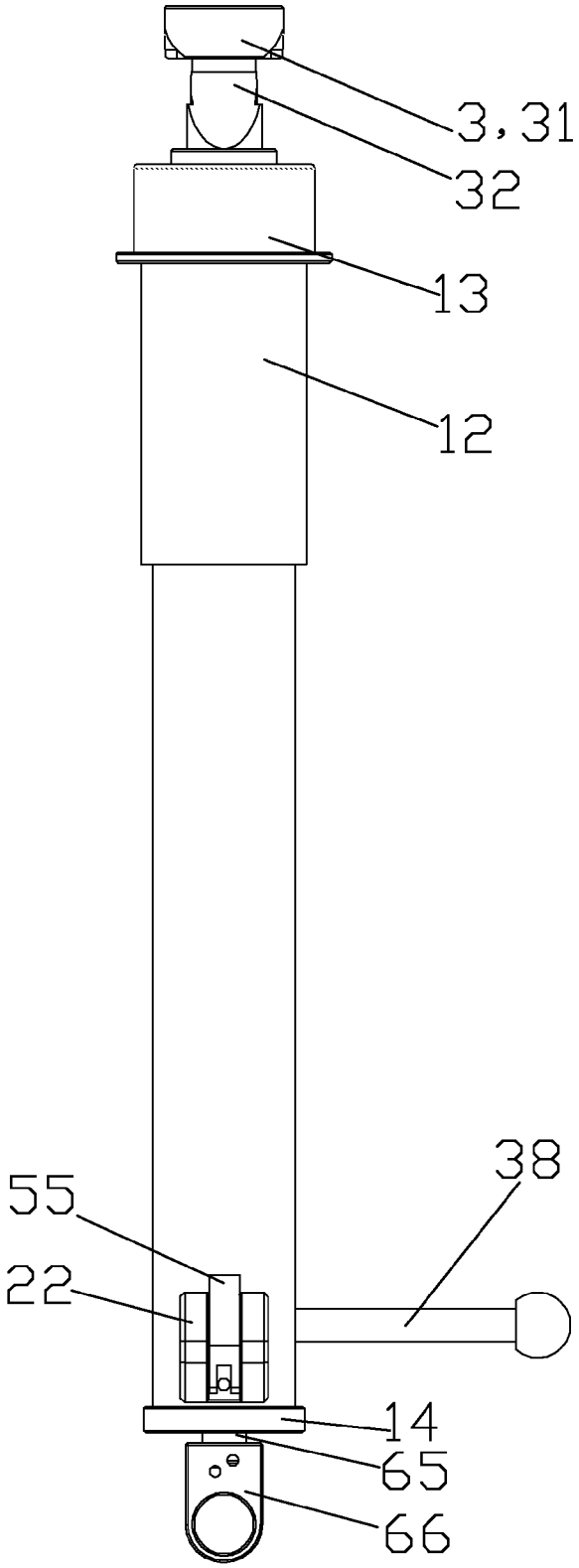
FIG. 2 illustrates a left view of FIG. 1.
Figure 3:
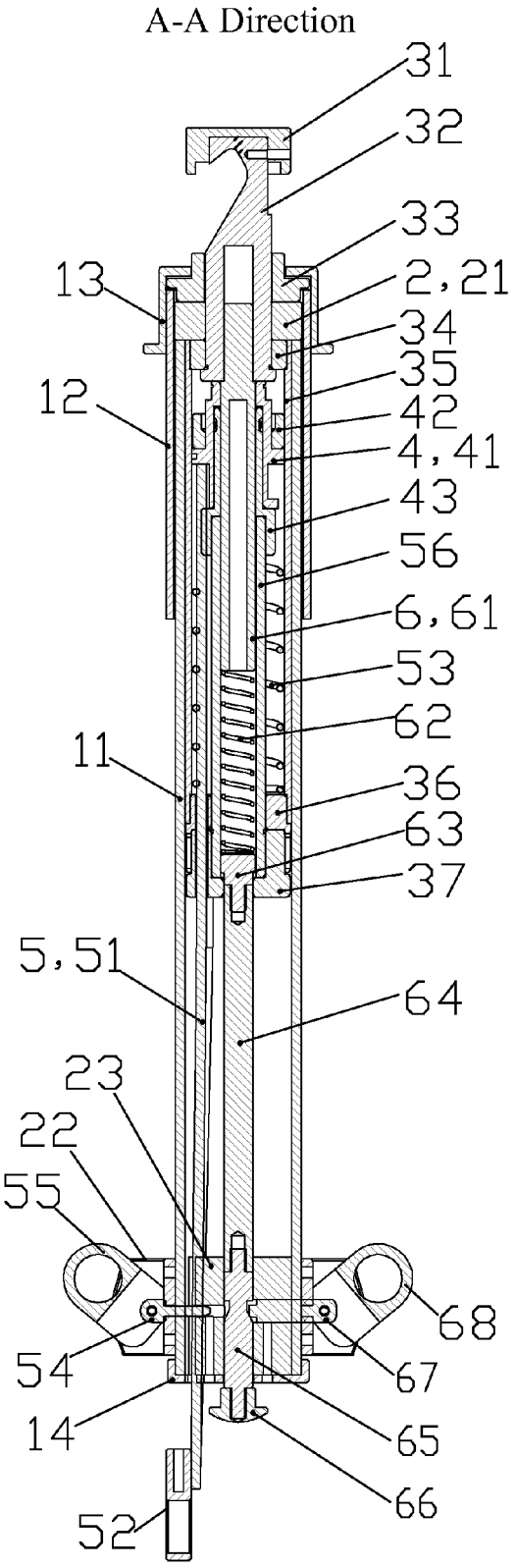
FIG. 3 illustrates a cross-sectional view of FIG. 1 along A-A line.
Figure 4:
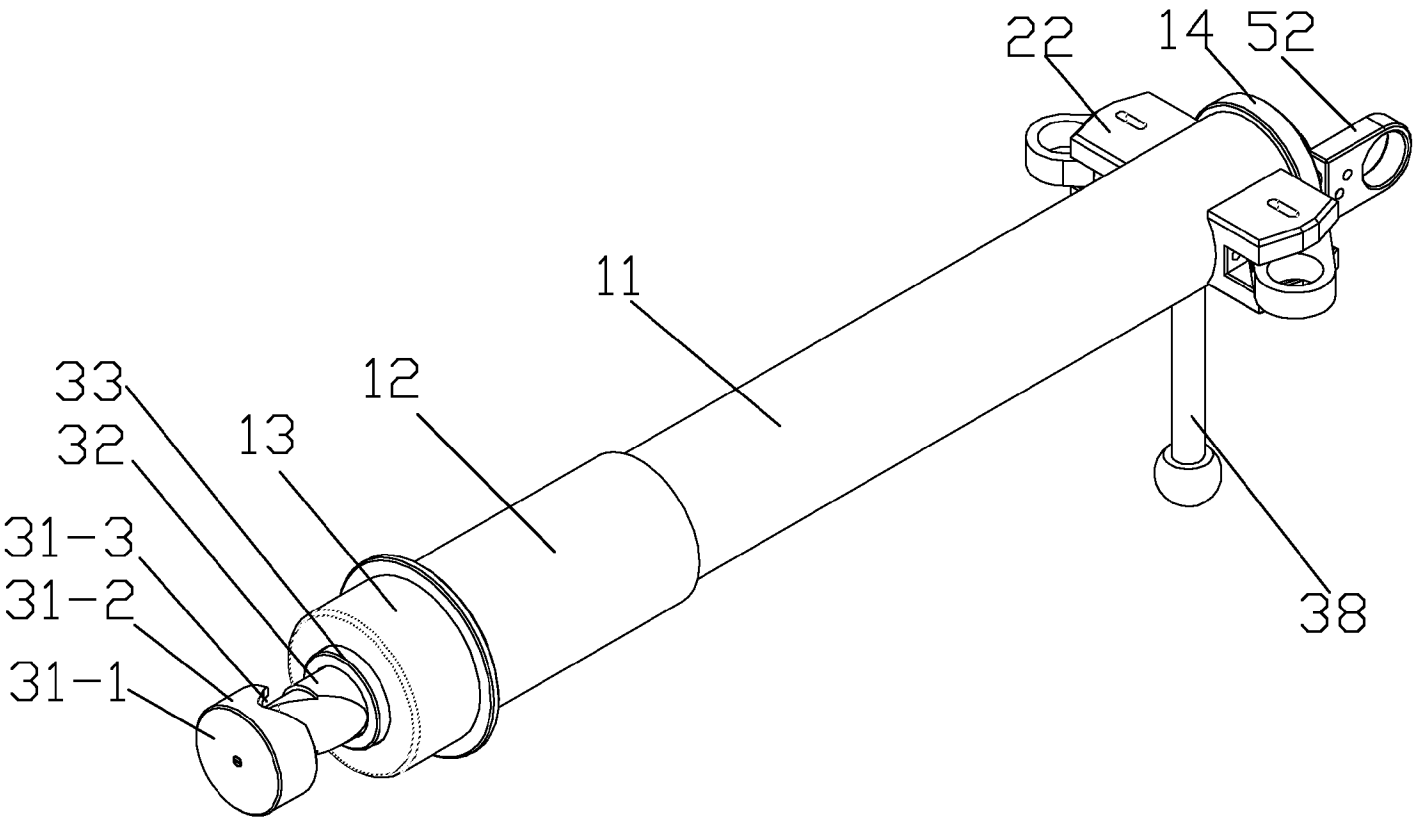
FIG. 4 is a perspective structural diagram of the present disclosure.

As shown in FIG. 1 to FIG. 4, the present embodiment discloses a portable single-phase air bypass switch for live distribution network in a power distribution network, including a housing member 1, a positioning member 2, a conductive circuit member 3, a clutch member 4, a switch-closing member 5, and a switch-opening member 6.

The housing member 1 includes a main sleeve tube 11, an insulating sleeve pipe 12, a flange sleeve 13 and a bottom cover 14.

The material of the main sleeve tube 11 may be transparent insulating polycarbonate. The shape of the main sleeve tube 11 may be a hollow cylinder. The left side and right side of the lower part of the main sleeve tube 11 each includes a through-hole, aligning along the left-right direction. The through-hole may be used to allow a positioning pin to pass through. The front lateral side of the lower part of the main sleeve tube 11 may be configured to have a through-hole for a conducting cord to pass through.

The material of the insulating sleeve pipe 12 may be insulated polycarbonate. The shape of the main sleeve tube 11 may be a hollow cylinder. The inner diameter of the insulating sleeve pipe 12 is compatible with the outer diameter of the main sleeve tube 11. The outside wall of the upper part of the insulating sleeve pipe 12 may be configured to have external screw threads used for assembling connection. The material of the flange sleeve 13 may be nylon. The flange sleeve 13 may include an upper plate, a main-body portion and a ring portion, all of which are connected together as one piece. The upper plate of the flange sleeve 13 may be a round-shaped plate. The center of the flange sleeve 13 may be configured to have a circular through-hole in vertical direction for assembling.

The main-body portion of the flange sleeve 13 may be configured to have a hollow cylindrical shape, and have internal screw threads in the inner wall for assembling connection. The ring portion of the flange sleeve 13 may be configured to have a ring shape and extend from the lower end of the main-body portion. The material of the bottom cover 14 may be aluminum alloy. The bottom cover 14 may include a round-shaped bottom plate and a ring portion, both of which are connected together as one piece. The ring portion of the bottom cover 14 may be configured on top of the bottom plate. The outer diameter of the ring portion may be the same as the diameter of the bottom plate. The middle part and the side part of the bottom plate of the bottom cover 14 are each provided with a through-hole in vertical direction for assembling.

The positioning member 2 includes a positioning nut 21, a positioning frame 22, and a positioning column 23. The material of the positioning nut 21 may be nylon. The positioning nut 21 may be a round-shaped nut, whose outer diameter is compatible with the inner diameter of the insulating sleeve pipe 12 of the housing member 1. The inner wall of the positioning nut 21 may be configured to have internal screw threads for connection.

The material of the positioning frame 22 may be nylon. The positioning frame 22 may include two ear plates and a central connection plate, all of which may be connected together as one piece. The two ear plates are respectively located at the front side and the back side of the central connection plate symmetrically. The two ear plates are each configured to have a locking pin hole 22-1 at symmetrical positions. During operation, a locking pin may be inserted to the locking pin holes 22-1 to avoid false operation.

The inner end surface of the central connection plate of the positioning frame 22 may be curved. The central connection plate may be configured to have a through-hole for positioning pin and screw holes for assembling and fixation. Two positioning frames 22 with same structure are provided. The material of the positioning column 23 may be aluminum alloy.

The overall shape of the positioning column 23 may be cylinder. The outer diameter of the positioning column 23 is compatible with the inner diameter of the main sleeve tube 11 of the housing member 1. A central portion and a side portion of the positioning column 23 in horizontal direction are each configured to have a vertical through-hole, serving as a mounting hole for connection rod and a through-hole for switch-closing energy-storage rod. The waist portion of the positioning column 23 in vertical direction may be provided with two through-holes in left-right direction, which are respectively used as a switch-closing positioning pin hole and a switch-opening positioning pin. The switch-closing positioning pin hole may pass, from left to right, the through-hole located at the side of the positioning column 23 for the switch-closing energy-storage rod, and connects to the mounting hole at the central portion of the positioning column 23 for the connection rod. The switch-opening positioning pin hole may connect, from right to left, to the mounting hole at the central portion of the positioning column 23 for the connection rod.

The conductive circuit member 3 mainly includes a conductive end cover 31, an upper conductive rod 32, a pressing sleeve 33, a coupling nut 34, a conductive sleeve pipe 35, a stationary contact 36, a movable contact 37, a lower conductive rod 38, and conductive flexible cords which are not illustrated in the figures.

The material of the conductive end cover 31 may be copper. The conductive end cover 31 includes a circular upper plate 31-1 and an annular edge 31-2, both of which may be connected together as one piece. The upper end of the annular edge 31-2 of the conductive end cover 31 and the lower end of the circular upper plate 31-1 are connected as one piece. The annular edge 31-2 of the conductive end cover 31 may be configured to have an upwardly recessed notch, which is the suspension groove 31-3.

The upper conductive rod 32 may be a whole piece made of copper. The upper conductive rod 32 may include, sequentially from top to bottom, a top portion, a connection portion, a cylinder portion and a ring portion, all of which are connected as one piece. The overall shape of the top portion of the upper conductive rod 32 may be a flat cylinder. The top portion may be configured inside the annular edge 31-2 of the conductive end cover 31. The top surface of the upper conductive rod 32 may contact and fixedly connect to the bottom surface of the circular upper plate 31-1 of the conductive end cover 31 by screws.

The top portion of the connection rod 32 may be configured to have an upwardly recessed notch compatible with the suspension groove 31-3 of the conductive end cover 31. The connection portion of the upper conductive rod 32 may be basically a circular truncated cone having a trapezoidal cross-section. The cylinder portion of the upper conductive rod 32 may be a hollow cylinder. The outer wall of the cylinder portion may be configured to have external screw threads for connection. The ring portion of the upper conductive rod 32 may be configured at the lower end of the cylinder portion and extend outwardly. The central hole of the cylinder portion of the upper conductive rod 32 may be a socket hole for a small shaft.

The pressing sleeve 33 may be a whole piece made of copper or aluminum. The pressing sleeve 33 may include, sequentially from top to bottom, an upper cylinder portion, a middle cylinder portion and a lower cylinder portion, all of which are connected together as one piece. The center of the upper cylinder portion, the middle cylinder portion and the lower cylinder portion of the pressing sleeve 33 may have coaxial circular through-holes in vertical direction with same inner diameter.

The inner diameter of the circular through-holes is compatible with the outer diameter of the cylinder portion of the upper conductive rod 32. Further, the inner walls of the circular through-holes may be configured to have internal screw threads for connection. The outer diameter of the upper cylinder portion of the pressing sleeve 33 is compatible with the inner diameter of circular through-hole of the upper plate of the flange sleeve 13 of the housing member 1. The outer diameter of the middle cylinder portion of the pressing sleeve 33 is compatible with the inner diameter of the main-body portion of the flange sleeve 13. The outer diameter of the lower cylinder portion of the pressing sleeve 33 is compatible with the inner diameter of the insulating sleeve pipe 12 of the housing member 1.

The coupling nut 34 may be made of copper. The coupling nut 34 may be a round-shaped nut, whose inner wall has internal screw threads for connection, and outer wall has external screw threads for connection.

The material of the conductive sleeve pipe 35 may be aluminum alloy. The conductive sleeve pipe 35 may be a hollow round tube. The inner walls of the upper end and the lower end of the conductive sleeve pipe 35 are both configured with internal screw threads for connection.

The stationary contact 36 may be a whole piece made of copper. The stationary contact 36 may include, from top to bottom, a truncated cone portion, a serration base portion and serrated protrusions, all of which may be connected together as one piece. The truncated cone portion of the stationary contact 36 may include an upper plate and a cylinder part. The upper plate may be a round-shaped plate. The side and the center of the upper plate may each be configured to have a through-hole in vertical direction. The cylinder part of the stationary contact 36 may be a hollow cylinder. The outer diameter of the cylinder portion may be the same as the outer diameter of the upper plate. The top surface of the cylinder portion and the bottom surface of the upper plate may be integrally connected.

The serration base portion may include a connection panel and a skirt edge. The connection panel of the serration base portion may be a ring-shaped plate, whose outer diameter may be greater than the outer diameter of the cylinder part of the truncated cone portion. The inner wall of the ring-shaped connection panel of the serration base portion may be integrally connected to the lower end of the outer wall of the cylinder part of the truncated cone portion. The skirt edge of the serration base portion may be a ring-shaped plate, whose upper end may be integrally connected with the lower end of the outer periphery of the connection panel of the serration base portion. There may be 6 to 20 serrated protrusions. The structures of the serrated protrusions may generally be the same. The upper end of each serrated protrusion may be integrally connected with the lower end of the skirt edge of the serration base portion. The serrated protrusions are distributed with even spacing. The serrated protrusions together form a surrounding ring. The serrated protrusions together form a ring, and the outer diameter of the formed ring may be the same as the outer diameter of the edge skirt of the serration base portion.

The movable contact 37 may have a step-like shape and made of copper. The movable contact 37 may include a cylinder portion configured at the upper part and a flat cylinder portion configured at the lower part, both of which may be connected together as one piece. The cylinder portion of the movable contact 37 may be a hollow cylinder, whose inner wall may be configured to have internal screw threads for connection. The side and the center of flat cylinder portion of the movable contact 37 may each have a through-hole in vertical direction. The through-hole on the side of the flat cylinder portion may be used as a through-hole for a switch-closing energy-storage rod. The through-hole at the center of the flat cylinder portion may be used as through-hole for connecting a switch-opening energy-storage shaft. The outer diameter of the flat cylinder portion of the movable contact 37 may be greater than the outer diameter of the cylinder portion. Further, the outer diameter of the cylinder portion of the movable contact 37 is compatible with the inner diameter of the skirt edge of the serration base portion of the stationary contact 36. In operation, when the movable contact 37 and the stationary contact 36 engage, a conductive loop may be connected.

The material of the lower conductive rod 38 may be aluminum alloy. The lower conductive rod 38 may be a hollow round tube. The lower conductive rod 38 may be fixedly mounted at the lower front lateral side of the main sleeve tube 11 of the housing member 1 where the through-hole used for passing through conductive cord is located. One end of the conductive cord may be electrically connected with the movable contact 37. The other end of the conductive rod leads out from the lower conductive rod.

The clutch member 4 mainly includes a clutch 41, a clutch ring 42, and a clutch sleeve pipe 43. The clutch 41 may be configured to have a hollow cylindrical inner chamber. The clutch ring 42 may be coupled and connected to the upper outer side of the clutch 41 for buffering. The clutch sleeve pipe 43 may be formed by integrally connected hollow upper cylindrical portion and a hollow lower cylindrical portion. The upper cylindrical portion of the clutch sleeve pipe 43 may be flexibly connected to the inner chamber of the clutch 41 and may be movable in vertical direction. The outer diameter of the lower cylindrical portion of the clutch sleeve pipe 43 may be greater than the outer diameter of the upper cylindrical portion. The inner wall of the lower cylindrical portion of the clutch sleeve pipe 43 may be configured with internal screw threads for connection.

The switch-closing member 5 may mainly include a switch-closing energy-storage rod 51, a switch-closing energy-storage ring 52, a switch-closing spring 53, a switch-closing positioning pin 54, a switch-closing release ring 55, and an inner sleeve pipe 56.

The material of the switch-closing energy-storage rod 51 may be insulated polycarbonate. The switch-closing energy-storage rod 51 may have a rod body.

The material of the switch-closing energy-storage ring 52 may be aluminum alloy. The switch-closing energy-storage ring 52 may be fixedly connected to the lower end of the switch-closing energy-storage rod 51. The switch-closing spring 53 may be configured inside the conductive sleeve pipe 35 of the conductive circuit member 3. The switch-closing release ring 55 may be a whole piece made of copper.

The material of the inner sleeve pipe 56 may be epoxy resin. The inner sleeve pipe 56 may be a hollow round tube. The outer walls of the upper end and lower end of the inner sleeve pipe 56 may both be configured to have external screw threads for connection. The outer diameter of the inner sleeve pipe 56 is compatible with the inner diameter of the lower cylindrical portion of the clutch sleeve pipe 43 of the clutch member 4, and compatible with the inner diameter of the cylinder portion of the movable contact 37.

The switch-opening member 6 may mainly include a small shaft 61, a switch-opening spring 62, a stopping block 63, a switch-opening energy-storage shaft 64, a connection rod 65, a switch-opening energy-storage pressing head 66, a switch-opening positioning pin 67, and a switch-opening release ring 68.

The material of the small shaft 61 may be epoxy resin. The small shaft 61 may include integrally-connected upper cylinder portion and a hollow lower cylinder portion. The diameter of the upper cylinder portion of the small shaft 61 is compatible with the inner diameter of the hollow cylinder portion of the upper conductive rod 31. The outer diameter of the lower cylinder portion of the small shaft 61 is compatible with the inner chamber of the clutch 41 and the inner diameter of the inner sleeve pipe 56. The material of the stopping block 63 may be stainless steel. The stopping block 63 may include an upper cylinder portion, a middle cylinder portion, and a lower cylinder portion, all of which are connected together as one piece. Further, the outer diameters of the upper cylinder portion, the middle cylinder portion and the lower cylinder portion are sequentially decreased. The outer wall of the lower cylinder portion of the stopping block 63 may be configured to have external screw threads for connection.

The material of the switch-opening energy-storage shaft 64 may be nylon. The switch-opening energy-storage shaft 64 may generally be a cylindrical piece. The centers of the upper end and the lower end of the switch-opening energy-storage shaft 64 may both be configured to have an inwardly recessed round hole. Further, the inner walls of the two round holes may both be configured to have internal screw threads for connection. The inner diameter of the inwardly recessed round holes at the upper end of the switch-opening energy-storage shaft 64 is compatible with the diameter of the lower cylinder portion of the stopping block 63.

The material of the connection rod 65 may be stainless steel. The connection rod 65 may be formed by an upper cylinder portion, a middle cylinder portion, and a lower cylinder portion, all of which are connected together as one piece. The outer walls of the upper cylinder portion and the lower cylinder portion of the connection rod 65 may both be configured to have external screw threads for connection. The diameter of the upper cylinder portion of the connection rod 65 is compatible with the inner diameter of the inwardly recessed round hole at the lower end of the switch-opening energy-storage shaft 64. The middle cylinder portion of the connection rod 65 may be configured to have an inwardly recessed positioning groove around the waist.

The switch-opening energy-storage pressing head 66 may be a whole piece made of aluminum alloy. The switch-opening energy-storage pressing head 66 may include a connection portion configured at the upper end and a pressing portion at the lower end, both of which may be connected together as one piece. The connection portion of the switch-opening energy-storage pressing head 66 may be a hollow cylinder, the inner wall of which may be configured to have internal screw threads for connection. Further, the inner diameter of the connection portion of the switch-opening energy-storage pressing head 66 is compatible with the outer diameter of the lower cylinder portion of the connection rod 65. The pressing portion of the switch-opening energy-storage pressing head 66 may have an arc shape projecting downward, which may ease pressing effort and provide comfort in operation.

The assembly and connection relationships among the previously-mentioned various components are described as follows.

The insulating sleeve pipe 12 and the outer upper part of the main sleeve tube 11 may be connected with an interference fit. The conductive sleeve pipe 35 of the conductive circuit member 3 and the inner upper part of the main sleeve tube 11 may be connected with an interference fit. The coupling nut 34 may use the internal screw threads to have threaded connection with the lower end of the middle cylinder portion of the upper conductive rod 32.

Further, the coupling nut 35 may be located above the ring portion of the upper conductive rod 32. The coupling nut 34 may use the external screw threads to have threaded connection with the inner wall of the upper part of the conductive sleeve pipe 35. The positioning nut 21 of the positioning member 2 may have threaded connection with the upper conductive rod 32, and may be located above the coupling nut 34.

The pressing sleeve 33 may have threaded connection with the upper conductive rod 32 and may be located above the positioning nut 21. The flange sleeve 13 may cover the pressing sleeve 33 from top to bottom and have threaded connection with the outer wall of the upper end of the insulating sleeve pipe 12. The upper conductive rod 32 may be fixedly connected with the conductive end cover 31 by a screw through the upper end portion.

The positioning column 23 of the positioning member 2 may be configured at the lower end inside the main sleeve tube 11. The bottom cover 14 of the housing member 1 may use the ring portion to fit and connect to the lower end of the main sleeve tube 11. Further, the bottom cover 14 of the housing member 1 may fixedly connected with the positioning column 23 by screws. The two positioning frames 22 may be respectively configured at the left side and the right side of the main sleeve tube 11 at the location where the positioning column 23 is. The switch-closing positioning pin 24 and the switch-opening positioning pin 25 may respectively pass through the positioning-pin through-hole in the central connection plate of the positioning frame 22. The switch-closing positioning pin 24 and the switch-opening positioning pin 25 may be respectively configured inside the switch-closing positioning pin hole and the switch-opening positioning pin hole, and are movable.

The stationary contact 36 of the conductive circuit member 3 may have threaded connection with the inner wall of the lower end of the conductive sleeve pipe 35. The movable contact 37 may be configured below the stationary contact 36. The clutch member 4 may be configured inside the conductive sleeve pipe 35 and located below the upper conductive rod 32.

The switch-closing spring 53 of the switch-closing member 5 may be configured inside the conductive sleeve pipe 35. The switch-closing spring 53 may be located between the clutch member 4 and the stationary contact 36. The switch-closing energy-storage rod 51 may pass through, sequentially from bottom to top, the through-holes on the side of the bottom cover 14, the positioning column 23, the movable contact 37 and the stationary contact 36. The upper end of the switch-closing energy-storage rod 51 may be fixedly connected with the clutch 42 of the clutch member 4. The switch-closing energy-storage ring 52 may be fixedly mounted at the lower end of the switch-closing energy-storage rod 51. The switch-closing release ring 55 may be elastically connected with the switch-closing positioning pin 54 by torsion spring. The upper end of the inner sleeve pipe 56 may have threaded connection with the clutch sleeve pipe 43 of the clutch member 4. The lower end of the inner sleeve pipe 56 may have threaded connection with the inner wall of the cylinder portion of the movable contact 37.

The upper cylinder portion of the small shaft 61 of the switch-opening member 6 may fit and connect inside the upper conductive rod 32. The lower cylinder portion of the small shaft 61 may have movable fit and connect with the inner chamber of the clutch 41 and inside the upper part of the inner sleeve pipe 56. The upper end of the switch-opening spring 62 may contact the lower end of the small shaft 61. The lower end of the switch-opening spring 62 may contact the upper end surface of the stopping block 63.

The lower cylinder portion of the stopping block 63 may pass through the through-hole at the center of the movable contact 37 and have threaded connection with the upper end of the switch-opening energy-storage shaft 64. The lower end of the switch-opening energy-storage shaft 64 may have threaded connection with the upper end of the connection rod 65. The connection rod 65 may have movable fit inside the connection rod mounting hole of the positioning column 23. The lower end of the connection rod 65 may have threaded connection with the switch-opening energy-storage pressing head 66. The switch-opening release ring 68 may have elastic connection with the switch-opening positioning pin 67 by torsion spring.

The portable single-phase air bypass switch for a live power distribution network disclosed in the embodiments may have the following operation principles and process.

The portable single-phase air bypass switch for a live power distribution network disclosed in the embodiments (abbreviated as "the switch" hereinafter), when in operation, may be hung on a to-be-inspected 10 kv line using the notch structure formed by both the conductive end cover 31 of the conductive circuit member 3 and the upper conductive rod 32. The conductive cord of the conductive circuit member 3 may be electrically connected to a branch, thereby forming a bypass during line maintenance of the 10 KV line.

When the switch is closed, a powered circuit loop is formed by the conductive end cover 31, the upper conductive rod 32, the pressing sleeve 33, the coupling nut 34, the conductive sleeve pipe 35, the stationary contact 36, the movable contact 37, and the conductive cords lead from the lower conductive rod 38. When the switch is open, the stationary contact 36 and the movable contact 37 are separated; the circuit loop is therefore disconnected.

The switch-closing energy-storage rod 53 of the switch-closing member 5 may be used to store energy for switch-closing. The switch-closing energy-storage ring 52 may pull the switch-closing energy-storage rod 51, and the switch-closing energy-storage rod may drive the clutch 41, the clutch sleeve pipe 43 and the inner sleeve 56 to move downward until the movable contact 37 is popped out. The switch is then opened.

Meanwhile, the switch-closing spring 53 is extended in vertical direction and at energy storage mode. When enough energy has been stored, under the tension of the torsion spring in the switch-closing release ring 55, the switch-closing positioning pin 54 inserts into the switch-closing positioning pin hole and fixate the position of the switch-closing energy storage rod 51. When the switch needs to be closed, the switch-closing release ring 55 may be pulled and drive the switch-closing positioning pin 54 to be pulled out, and thus releasing the switch-closing energy storage rod 51. With the elasticity of the switch-closing spring 53, the clutch 41, the clutch sleeve pipe 43, the inner sleeve pipe 56 and the movable contact 37 may move upward. The movable contact 37 and the stationary contact 36 may engage, and the switch is closed.

The switch-opening spring 62 of the switch-opening member 6 may be used to store energy for switch opening. When the switch is closed, the switch-opening spring 62 is storing energy: pressing up the switch-opening energy-storage pressing head 66, which drives the connection rod 65, the switch-opening energy-storage shaft 64, the stopping block 63, the switch-opening spring 62 and the small shaft 61 to move upward.

The small shaft 61 is limited by the middle cylinder portion of the upper conductive rod 32 and may not move, thus the switch-opening spring 62 may store energy correspondingly. When enough energy has been stored, the switch-opening positioning pin 67 may position the connection rod 65. When the switch need to be opened, the switch-opening release ring 68 may be pulled and release the connection rod 65. With the elasticity of the switch-opening spring 62, the small shaft 61, the stopping block 63, the switch-opening energy-storage shaft 64, the connection rod 65 and the switch-opening energy-storage pressing head 66 may move downward. The stopping block 63 may press the movable contact 37 to move downward, and thus separating the movable contact 37 and the stationary contact 36. The switch is opened.

Opening the switch, storing energy for switch-closing, closing the switch and storing energy for switch-closing may occur alternately.

Accordingly, the disclosed portable single-phase air bypass switch for a live power distribution network may overcome the shortcomings of the USLR-XLI series air bypass switch made by Utility Solutions, which only has a closing function. The disclosed switch combines both opening and closing functions in one device, effectively enhances work efficiencies of short-term recovery of distribution network when a lead is dismantled in a live line, and provides security during the live work. For the first time, the main sleeve tube of the housing member is manufactured by transparent polycarbonate material. During operation, one can observe clearly the action status and the engaging situation of the stationary contact and the movable contact, which can effectively prevent workers from electrical burns caused by rejected action, faulty action, poor engagement between the stationary contact and movable contact. Safety hazard may thus be prevented. The movable contact of the conductive circuit member has a round step-like shape. The stationary contact may implement a serrated step-like shape design. Applying aerodynamics principles, with evenly distributed serrations of the stationary contact, dispersing the electrical arc generated instantly when the stationary contact and the movable contact engages can be effectively implemented by compressing the air. The arc absorbing ability of the arc-quenching chamber may be significantly improved. The difficulties when dealing with momentary arcs for similar switches may be effectively solved. The total weight of the switch may be about 2.5 kg. The switch is easy to carry for high-altitude operations, easy to operate and easy to maintain. The switch meets the needs of live distribution network for overhead power lines and has high applicability. In operation, the switch may suspend, by the conductive rod, on the live overhead line, without a frame or base and with a rated current at 400 A. During load breaking or load returning, charging current of the unloaded line is greater than 10 A, which meet the needs of live 10 KV distribution network, and fill the gaps in the art at home and abroad Other embodiments of the disclosure will be apparent to those skilled in the art from consideration of the specification and practice of the invention disclosed herein. It is intended that the specification and examples be considered as exemplary only, with a true scope and spirit of the invention being indicated by the claims.

INDUSTRIAL APPLICABILITY AND ADVANTAGEOUS EFFECTS

The present invention has various advantageous effects. (1) The disclosed portable single-phase air bypass switch for a live power distribution network overcome the shortcomings of the USLR-XLI series air bypass switch made by Utility Solutions, which only has a closing function. The disclosed switch combines both opening and closing functions in one body, effectively enhancing work efficiencies of short-term recovery of distribution network when a lead is dismantled in a live line, and providing security during the live work.

(2) For the first time, the main sleeve tube of the housing member is manufactured by transparent polycarbonate material. During operation, one can observe clearly the action status and the engaging status of the stationary contact and the movable contact, which can effectively prevent workers from electrical burns caused by rejected action, faulty action, poor engagement between the stationary contact and movable contact. Safety hazard may thus be prevented.

(3) The movable contact of the conductive circuit member has a round step-like shape. The stationary contact may implement a serrated step-like shape design. Applying aerodynamics principles, with evenly distributed serrations of the stationary contact, dispersing the electrical arc generated instantly when the stationary contact and the movable contact engages can be effectively implemented by compressing the air. The arc absorbing ability of the arc-quenching chamber may be significantly improved. The difficulties when dealing with momentary arcs for similar switches may be effectively solved.

(4) The total weight of the switch may be about 2.5 kg. The switch is easy to carry for high-altitude operations, easy to operate and easy to maintain. The switch meets the needs of live distribution network for overhead power lines and has high applicability.

(5) In use, the switch may suspend, by the conductive rod, on the live overhead line, without a frame or base and with a rated current at 400 A. During load breaking or load returning, charging current of the unloaded line is greater than 10 A, which meet the needs of 10 KV distribution network live work, and fill the gaps in the art at home and abroad.

What is claimed is:

1. A portable single-phase air bypass switch for a live power distribution network, comprising: a housing member, a positioning member, a conductive circuit member, a clutch member, a switch-closing member and a switch-opening member, wherein:

the housing member includes a main sleeve tube, an insulating sleeve pipe, a flange sleeve, and a bottom cover; the positioning member includes a positioning nut, positioning frames, and a positioning column; the conductive circuit member includes a conductive end cover, an upper conductive rod, a pressing sleeve, a coupling nut, a conductive sleeve pipe, a stationary contact, a movable contact, and a lower conductive rod; the clutch member includes a clutch, a clutch ring, and a clutch sleeve pipe; the switch-closing member includes a switch-closing energy-storage rod, a switch-closing energy-storage ring, a switch-closing spring, a switch-closing positioning pin, a switch-closing release ring, and an inner sleeve pipe; the switch-opening member include a small shaft, a switch-opening spring, a stopping block, a switch-opening energy-storage shaft, a connection rod, a switch-opening energy-storage pressing head, a switch-opening positioning pin, and a switch-opening release ring;

the insulating sleeve pipe and an outer periphery of an upper part of the main sleeve tube are connected with an interference fit; the conductive sleeve pipe and an inner periphery of the upper part of the main sleeve tube are connected with an interference fit; the coupling nut is a nut with both internal screw threads and external screw threads; the coupling nut has threaded connection with a lower end of the upper conductive rod by the internal screw thread; the coupling nut has threaded connection with an inner wall of an upper part of the conductive sleeve pipe by the external screw thread; the positioning nut has threaded connection with the upper conductive rod and is located above the coupling nut; the pressing sleeve has threaded connection with the upper conductive rod and is located above the positioning nut; the flange sleeve covers the pressing sleeve from top to bottom and has threaded connection with an outer wall of an upper end of the insulating sleeve pipe; the upper conductive rod is fixedly connected with the conductive end cover;

the positioning column is coupled and connected to a lower part inside the main sleeve tube, the bottom cover is coupled and connected to a lower end of the main sleeve tube, and is fixedly connected with the positioning column; a left side and a right side of a vertically waist portion of the positioning column are each provided with a switch-closing positioning pin-hole and a switch-opening positioning pin-hole; the main sleeve tube is configured to have a switch-closing positioning pin through-hole and a switch-opening positioning pin through-hole at corresponding locations of the switch-closing positioning pin-hole and the switch-opening positioning pin-hole in the positioning column; the switch-closing positioning pin and the switch-opening positioning pin respectively pass through the switch-closing positioning pin through-hole and the switch-opening positioning pin through-hole in the main sleeve tube, and is movably located in the switch-closing positioning pin-hole and the switch-opening positioning pin-hole in the positioning column; the switch-closing release ring is elastically connected with the switch-closing positioning pin by torsion spring; the switch-opening release ring is elastically connected with the switch-opening positioning pin by torsion spring; a quantity of the positioning frames is two, the two positioning frames are respectively configured at a left side and a right side of the main sleeve tube and are fixedly connected with the main sleeve tube; the stationary contact has threaded connection with an inner wall of a lower end of the conductive sleeve pipe; the movable contact is located underneath the stationary contact; the clutch member is configured inside the conductive sleeve pipe and is located underneath the upper conductive rod; the switch-closing spring is configured inside the conductive sleeve pipe; the switch-closing spring is located in between the clutch member and the stationary contact;

the bottom cover, the positioning column, the movable contact and the stationary contact are configured to have vertical through-holes at lateral sides in left-right direction and in a center; the switch-closing energy-storage rod passes through, sequentially from bottom to top, the through-holes at the lateral sides of the bottom cover, the positioning column, the movable contact and the stationary contact, and an upper end of the switch-closing energy-storage rod is fixedly connected with the clutch; the switch-closing energy-storage ring is fixedly mounted at a lower end of the switch-closing energy-storage rod; an upper end of the inner sleeve pipe has threaded connection with the clutch sleeve pipe; a lower end of the inner sleeve pipe has threaded connection with the movable contact;

an upper part of the small shaft is coupled and connected inside the upper conductive rod, middle and lower parts of the small shaft has movable fit and connects with an inner chamber of the clutch and inside an upper part of the inner sleeve pipe; the switch-opening spring is configured inside the inner sleeve pipe, and an upper end of the switch-opening spring contacts a lower end of the small shaft; a lower end of the switch-opening spring contacts an upper end surface of the stopping block; a lower end of the stopping block passes through a through-hole in a center of the movable contact and has threaded connection with an upper end of the switch-opening energy-storage shaft; a lower end of the switch-opening energy-storage shaft has threaded connection with an upper end of the connection rod; the connection rod has movable fit and connects to the through-hole in the center of the positioning column, a lower end of the connection rod has threaded connection with the switch-opening energy-storage pressing head; and a front lateral side of a lower part of the main sleeve tube is configured to have a through-hole for passing through conductive cords; the lower conductive rod is a hollow round tube; a first end of the lower conductive rod is fixedly connected with the main sleeve tube at where the through-hole for passing through conductive cords is located.

2. The switch according to claim 1, wherein: the main sleeve tube of the housing member is a whole piece hollow cylinder made of transparent insulating polycarbonate; the insulating sleeve pipe is a whole piece hollow cylinder made of insulated polycarbonate, an inner diameter of the insulating sleeve pipe is compatible with an outer diameter of the main sleeve tube; the outer wall of the upper end of the insulating sleeve pipe is configured to have external screw threads; the flange sleeve is a whole piece made of nylon; the flange sleeve includes an upper plate, a main-body portion, and a ring portion; the upper plate of the flange sleeve is a round-shaped plate, a center of the flange sleeve is configured to have a vertical through-hole; the main-body portion of the flange sleeve is configured to have a hollow cylindrical shape, and have internal screw threads in the inner wall for assembling connection; the ring portion of the flange sleeve is configured to have a ring shape and extend from a lower end of the main-body portion; the bottom cover is a whole piece made of aluminum alloy, the bottom cover includes a round-shaped bottom plate and a ring portion; the ring portion of the bottom cover is configured on top of the bottom plate, and an outer diameter of the ring portion is the same as a diameter of the bottom plate.

3. The switch according to claim 2, wherein: the positioning nut of the positioning member is a round-shaped nut made of nylon, whose outer diameter is compatible with an inner diameter of the insulating sleeve pipe; an inner wall of the poisoning nut is configured to have internal screw threads for connection; the positioning frames are each a whole piece made of aluminum alloy; the positioning frame includes two ear plates and a central connection plate; the two ear plates are respectively located at a front side and a back side of the central connection plate symmetrically; the two ear plates are each configured to have a locking pin hole at symmetrical positions; an inner end surface of the central connection plate of the positioning frame is curved, the central connection plate is configured to have a through-hole for a positioning pin; the positioning column is a cylindrical whole piece made of aluminum alloy, and an outer diameter of the positioning column is compatible with an inner diameter of the main sleeve tube.

4. The switch according to claim 3, wherein: the conductive circuit member further includes conductive cords; the conductive end cover is a whole piece made of copper; the conductive end cover includes a circular upper plate and an annular edge; the annular edge of the conductive end cover is configured to have an upwardly recessed suspension groove;

the upper conductive rod is a whole piece made of copper; the upper conductive rod includes, sequentially from top to bottom, a top portion, a connection portion, a cylinder portion, and a ring portion; an overall shape of the top portion of the upper conductive rod is a flat cylinder; the top portion of the upper conductive rod is configured inside the annular edge of the conductive end cover; a top surface of the upper conductive rod contacts a bottom surface of the circular upper plate of the conductive end cover; the top portion of the connection rod is configured to have an upwardly recessed notch compatible with the suspension groove of the conductive end cover; the connection portion of the upper conductive rod is basically a circular truncated cone having a trapezoidal cross-section; the cylinder portion of the upper conductive rod is a hollow cylinder; an outer wall of the cylinder portion is configured to have external screw threads for connection; the ring portion of the upper conductive rod is configured at a lower end of the cylinder portion and extends outward; a central hole of the cylinder portion of the upper conductive rod is a socket hole for fitting the small shaft;

the pressing sleeve is a whole piece made of copper or aluminum; the pressing sleeve includes, sequentially from top to bottom, an upper cylinder portion, a middle cylinder portion, and a lower cylinder portion; the centers of the upper cylinder portion, the middle cylinder portion and the lower cylinder portion of the pressing sleeve have coaxial circular through-holes in vertical direction with same inner diameter; an inner diameter of the circular through-holes is compatible with an outer diameter of the cylinder portion of the upper conductive rod; inner walls of the circular through-holes are configured to have internal screw threads for connection; an outer diameter of the upper cylinder portion of the pressing sleeve is compatible with an inner diameter of circular through-hole in the upper plate of the flange sleeve; an outer diameter of the middle cylinder portion of the pressing sleeve is compatible with an inner diameter of the flange sleeve; an outer diameter of the lower cylinder portion of the pressing sleeve is compatible with an inner diameter of the insulating sleeve pipe;

the coupling nut is a round-shaped nut made of copper; an inner diameter of the coupling nut is compatible with an outer diameter of the cylinder portion of the upper conductive rod; an outer diameter of the coupling nut is compatible with an inner diameter of the conductive sleeve pipe; the conductive sleeve pipe is a hollow round tube made of aluminum alloy; inner walls of an upper end and an lower end of the conductive sleeve pipe are both configured with internal screw threads for connection;

the stationary contact is a whole piece made of copper, including, from top to bottom, a truncated cone portion, a serration base portion and serrated protrusions; the truncated cone portion of the stationary contact include an upper plate and a cylinder part; the upper plate is a round-shaped plate; a lateral through-hole and a central through-hole are respectively configured at a lateral side and in the center of the upper plate; the cylinder part of the stationary contact is a hollow cylinder; an outer diameter of the cylinder part is the same as an outer diameter of the upper plate; a top surface of the cylinder part and the bottom surface of the upper plate is integrally connected; the serration base portion includes a connection panel and a skirt edge; the connection panel of the serration base portion is a ring-shaped plate, whose outer diameter is greater than an outer diameter of the cylinder part of the truncated cone portion; an inner wall of the ring-shaped connection panel of the serration base portion is integrally connected to a lower end of the outer wall of the cylinder part of the truncated cone portion; the skirt edge of the serration base portion is a ring-shaped plate, whose upper end is integrally connected with an outer periphery of a bottom surface of the connection panel of the serration base portion; a quantity of the serrated protrusions is 6 to 20; structures of the serrated protrusions are the same; an upper end of each serrated protrusion is integrally connected with a lower end of the skirt edge of the serration base portion; the serrated protrusions are distributed with even spacing; the serrated protrusions together form a surrounding ring;

the movable contact is a step-shaped whole piece made of copper; the movable contact includes a hollow cylinder portion configured at an upper part and a flat cylinder portion configured at a lower part; an outer diameter of the cylinder portion of the movable contact is less than an outer diameter of the cylinder portion, and an outer diameter of the cylinder portion of the movable contact is compatible with an inner diameter of the skirt edge of the serration base portion of the stationary contact; an inner wall of the cylinder portion of the movable contact is configured to have internal screw threads for connection; the through-holes at the lateral side and at the center of the movable contact are configured at the lateral side and at the center of flat cylinder portion; and a first end of the conductive cord is electrically connected with the movable contact; a second end of the conductive cord leads out from the lower conductive rod.

5. The switch according to claim 4, wherein: the clutch of the clutch member is configured to have a hollow cylindrical inner chamber; the clutch ring is coupled and connected to an upper outer side of the clutch; the clutch sleeve pipe is formed by integrally connected hollow upper cylindrical portion and a hollow lower cylindrical portion; an outer diameter of the lower cylindrical portion of the clutch sleeve pipe is greater than an outer diameter of the upper cylindrical portion; the upper cylindrical portion of the clutch sleeve pipe is flexibly coupled and connected to the inner chamber of the clutch; an inner wall of the lower cylindrical portion of the clutch sleeve pipe is configured with internal screw threads for connection.

6. The switch according to claim 5, wherein: the switch-closing energy-storage rod of the switch-closing member has a rod body made of insulated polycarbonate; the switch-closing energy-storage ring and the switch-closing release ring are made of aluminum alloy; the inner sleeve pipe is a hollow pipe made of epoxy resin; outer walls of an upper end and a lower end of the inner sleeve pipe are both configured to have external screw threads; an outer diameter of the inner sleeve pipe is compatible with an inner diameter of the lower cylindrical portion of the clutch sleeve pipe, and compatible with an inner diameter of the cylinder portion of the movable contact.

7. The switch according to claim 6, wherein: the small shaft of the switch-opening member is a whole piece made of epoxy resin; the small shaft includes integrally-connected an upper cylinder portion and a hollow lower cylinder portion; a diameter of the upper cylinder portion of the small shaft is compatible with an inner diameter of the hollow cylinder portion of the upper conductive rod; an outer diameter of the lower cylinder portion of the small shaft is compatible with the inner chamber of the clutch and an inner diameter of the inner sleeve pipe; the stopping block is a whole piece made of stainless steel; the stopping block includes an upper cylinder portion, a middle cylinder portion, and a lower cylinder portion; outer diameters of the upper cylinder portion, the middle cylinder portion, and the lower cylinder portion are sequentially decreased; an outer wall of the lower cylinder portion of the stopping block is configured to have external screw threads for connection;

the switch-opening energy-storage shaft is a cylindrical whole piece made of nylon; centers of an upper end and a lower end of the switch-opening energy-storage shaft are each configured to have an inwardly recessed round hole, inner walls of the two round holes are both configured to have internal screw threads for connection; the connection rod is a whole piece made of stainless steel; the connection rod includes an upper cylinder portion, a middle cylinder portion, and a lower cylinder portion; outer walls of the upper cylinder portion and the lower cylinder portion of the connection rod are both configured to have external screw threads for connection; the middle cylinder portion of the connection rod is configured to have an inwardly recessed positioning groove around waist position; and the switch-opening energy-storage pressing head is a whole piece made of aluminum alloy; the switch-opening energy-storage pressing head includes a connection portion configured at an upper end and a pressing portion at a lower end; the connection portion of the switch-opening energy-storage pressing head is a hollow cylinder, an inner wall of which is configured to have internal screw threads for connection; the pressing portion of the switch-opening energy-storage pressing head has an arc shape projecting downward.

* * * * *